US009306283B2

(12) United States Patent
Shimizu et al.

(10) Patent No.: US 9,306,283 B2
(45) Date of Patent: Apr. 5, 2016

(54) ANTENNA DEVICE AND METHOD FOR INCREASING LOOP ANTENNA COMMUNICATION RANGE

(71) Applicant: Sony Corporation, Minato-ku (JP)

(72) Inventors: Kanjiro Shimizu, Tokyo (JP); Masayoshi Murata, Tokyo (JP)

(73) Assignee: Sony Corporation, Tokyo (JP)

( * ) Notice: Subject to any disclaimer, the term of this patent is extended or adjusted under 35 U.S.C. 154(b) by 133 days.

(21) Appl. No.: 14/163,610

(22) Filed: Jan. 24, 2014

(65) Prior Publication Data

US 2015/0214619 A1 Jul. 30, 2015

(51) Int. Cl.

| | |
|---|---|
| ***H01Q 7/00*** | (2006.01) |
| ***H01Q 1/22*** | (2006.01) |
| ***H01Q 1/38*** | (2006.01) |
| ***H01Q 9/27*** | (2006.01) |
| ***H01Q 1/24*** | (2006.01) |

(52) U.S. Cl.

CPC ..... *H01Q 7/00* (2013.01); *H01Q 1/2225* (2013.01); *H01Q 1/243* (2013.01); *H01Q 1/38* (2013.01); *H01Q 7/005* (2013.01); *H01Q 9/27* (2013.01)

(58) Field of Classification Search

CPC ..... H01Q 7/00; H01Q 1/243
USPC ..... 343/702, 748; 455/552.1, 41.2
See application file for complete search history.

(56) References Cited

U.S. PATENT DOCUMENTS

| | | | | |
|---|---|---|---|---|
| 8,479,999 | B2 * | 7/2013 | Koujima et al. | 235/492 |
| 8,736,495 | B2 | 5/2014 | Cho | |
| 2001/0011012 | A1 | 8/2001 | Hino et al. | |
| 2003/0098814 | A1 | 5/2003 | Keller, III et al. | |
| 2005/0079820 | A1 * | 4/2005 | Yamashita | 455/41.2 |
| 2007/0052600 | A1 * | 3/2007 | Kamitani et al. | 343/702 |
| 2007/0095926 | A1 | 5/2007 | Zhu et al. | |
| 2008/0117118 | A1 | 5/2008 | Hino et al. | |
| 2009/0152362 | A1 | 6/2009 | Ayala et al. | |
| 2010/0093390 | A1 * | 4/2010 | Waku et al. | 455/552.1 |
| 2012/0249396 | A1 | 10/2012 | Parsche | |
| 2013/0244577 | A1 | 9/2013 | Cheikh | |

FOREIGN PATENT DOCUMENTS

EP 2 045 872 A1 4/2009

OTHER PUBLICATIONS

Extended European Search Report issued Apr. 22, 2014 in Patent Application No. 14159587.6.

* cited by examiner

*Primary Examiner* — Jean B Jeanglaude
(74) *Attorney, Agent, or Firm* — Oblon, McClelland, Maier & Neustadt, L.L.P

(57) ABSTRACT

A device includes a first loop antenna and a second loop antenna. The first loop antenna includes at least three sides, wherein at least two of the sides form an acute interior angle. The second loop antenna includes at least one side that runs in a substantially parallel direction to one of the at least three sides of the first loop antenna. The first loop antenna and the second loop antenna are arranged substantially on the same plane.

19 Claims, 10 Drawing Sheets

ANTENNA DEVICE AND METHOD FOR INCREASING LOOP ANTENNA COMMUNICATION RANGE

BACKGROUND

1. Technical Field

The present disclosure relates to near field communication and related antenna devices.

2. Description of Related Art

Communication systems utilizing Near Field Communication (NFC) techniques may implement data exchange between a reader/writer device and a tag when the reader/writer device and the tag are in close proximity (e.g., less than 10 cm) to each other. The reader/writer device may include a power source and an NFC loop antenna. The tag may include a loop antenna and a memory element. In certain implementations, the tag may be a passive (i.e., unpowered) device. Using the power source and the NFC loop antenna circuitry, the reader/writer device may generate an electromagnetic field that can be used to implement contactless radio communication with the tag. The electromagnetic field generated by the reader/writer device may induce a current flow in the tag, which results in inductive coupling between the reader/writer device and the tag. As a result, data may be exchanged between the reader/writer device and the tag without the need for a physical connection between the two devices. For example, the reader/writer device may transmit an instruction signal to the tag when inductive coupling is established, and the tag may transmit a response signal to the reader/writer device following receipt of the instruction signal.

Communication range for systems implementing NFC techniques is limited and therefore, implementations of such NFC systems may be directed to payment services using a mobile terminal device, where transmissions over a long distance are not necessarily desired. Other implementations of NFC communication systems may be directed to an authentication procedure for various data exchange (e.g., for image and audio data transmission/reception on longer range wireless communication systems).

SUMMARY

In an NFC communication system, electric power and data signals are exchanged using a varying magnetic field (which acts as a carrier for the data signals) generated by the reader/writer device. Therefore, the relative positional relationships and corresponding communication range limitations of the reader/writer device and the tag will be dependent upon, e.g., the direction of the magnetic field(s), the intensity distribution of the magnetic field(s), antenna sizing, antenna shape, and the shape of the tag.

Techniques for increasing a communication range of an NFC antenna device may include using a double resonance antenna structure. In an NFC device implementing double resonance techniques, a relay may be included in a closed circuit with a capacitor and loop antenna, whereby the loop antenna circuit may resonate to a predetermined frequency that the reader/writer device and the tag mutually transmit. As a result, the distance at which the reader/writer device and the tag may communicate increases in a direction perpendicular to a plane formed by the loop antenna.

However, double resonance techniques do not address communication problems that arise as a result of positional shift in a direction parallel to the loop antenna. For example, in recent years, mobile terminal devices such as smartphones may include NFC technology such that peer-to-peer (P2P) communications may be performed. In this case, the mobile terminal devices may include functionality corresponding to both the reader/writer device and the tag discussed above. Additionally, the mobile terminal devices may be dissimilar in size, such as when one device is a smartphone and one is a relatively larger tablet device. Due to the size differences between the two devices and structures of NFC circuits included therein, there is an issue that in spite of having the two devices in direct contact, communication failures occur due to a positional shift of one device's NFC circuitry relative to another. This results in an undue burden on the user. Therefore, to reduce this burden and provide for increased versatility in NFC data exchange between devices of varied size, an antenna device and corresponding method for increasing a communication range of a loop antenna in a direction parallel to the loop surface is needed.

In certain embodiments, a device includes a first loop antenna and a second loop antenna. The first loop antenna includes at least three sides, wherein at least two of the sides form an acute interior angle. The second loop antenna includes at least one side that runs in a substantially parallel direction to one of the at least three sides of the first loop antenna. The first loop antenna and the second loop antenna are arranged substantially on the same plane.

The foregoing general description of the illustrative embodiments and the following detailed description thereof are merely exemplary aspects of the teachings of this disclosure, and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1:
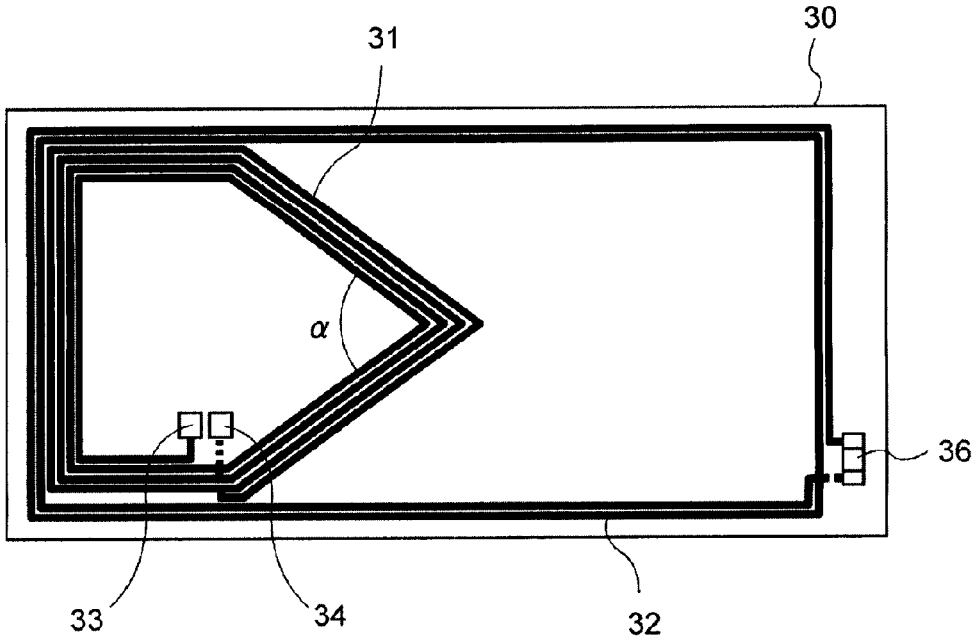
FIG. 1 is a top view illustrating a structure of an exemplary NFC antenna device, according to certain embodiments.

Referring now to the drawings, wherein like reference numerals designate identical or corresponding parts throughout the several views.

Referring first to FIG. 1, FIG. 1 illustrates a structure of an exemplary NFC antenna device, according to certain embodiments. The exemplary antenna device of FIG. 1 includes a first loop antenna 31 and a second loop antenna 32, which are both disposed on a printed circuit board 30. In certain embodiments, the printed circuit board, including the two loop antennas, may be installed in a terminal device such as a smartphone or tablet. The printed circuit board 30 may be a single-layer circuit board or a multi-layer circuit board. The printed circuit board 30 may, for example, use a film such as a polyimide as a base substance on which a wiring pattern for the loop antennas is formed.

In the example of FIG. 1, the printed circuit board 30 includes terminals 33 and 34, which are connected to respective ends of the first loop antenna 31. In certain embodiments, the terminals 33 and 34 may provide an electrical connection between the first loop antenna 31 and a power source or other circuitry. In contrast to the first loop antenna 31, the second loop antenna 32 in the example of FIG. 1 does not include terminals for establishing an electrical connection between the second loop antenna 32 and the printed circuit board 30. Accordingly, the resonant frequency of the second loop antenna 32 may be adjusted (e.g., via tuning circuitry or other techniques) separately from the first loop antenna 31.

The first loop antenna 31 and the second loop antenna 32 illustrated in the example of FIG. 1 are arranged on the same surface of the printed circuit board 30. In other embodiments, the first loop antenna 31 and the second loop antenna 32 may be arranged on different surfaces of the printed circuit board 30. For example, the first loop antenna 31 and the second loop antenna 32 may be arranged on opposing sides of the printed circuit board 30 (e.g., a front surface and a back surface). In select embodiments, the printed circuit board 30 may be a multi-layered circuit board, whereby the first loop antenna 31 and the second loop antenna 32 may be disposed on different layers of the printed circuit board 30. In general, the first loop antenna 31 and the second loop antenna 32 are arranged on substantially the same plane. It should be understood that for the purposes of the present disclosure, arranging the first and second loop antennas on substantially the same plane may be understood to be an arrangement with respect to an imaginary planar surface of non-arbitrary thickness. For example, the first loop antenna 31 and the second loop antenna 32 are arranged on substantially the same plane when the two loop antennas are disposed on a common circuit board, but not necessarily the same surface of the circuit board.

The first loop antenna 31 of FIG. 1 has a substantially polygonal shape with at least three sides. Further, at least two sides of the first loop antenna 31 form an acute interior angle $\alpha$. Although the sides of the first loop antenna 31 shown in FIG. 1 are straight, in certain embodiments the sides of the first or second loop antenna may be curved. Additionally, the first loop antenna 31 (and any other loop antennas described herein) may have one or more loops, whereby the number of loops may be selected based on the type of application in which the loop antenna is implemented and/or desired performance characteristics of the loop antenna. Moreover, the shape and arrangement position of the terminals 33 and 34 which form a substrate connection for the first loop antenna 31 are not limited to the arrangement and size illustrated in FIG. 1, but rather may be selected based on the application type or other considerations. Moreover, a capacitor may be installed between the terminals 33 and 34, as needed.

Referring now to the second loop antenna 32, the loop shape formed by the second loop antenna 32 in FIG. 1 has a substantially polygonal shape. In certain embodiments, the second loop antenna 32 includes at least one side that runs in a substantially parallel direction to at least one of the three sides forming the first loop antenna 31. In certain embodiments, the first loop antenna 31 is disposed within an interior perimeter of the second loop antenna 32. In other embodiments, the second loop antenna 32 may be disposed within an interior perimeter of the first loop antenna 31. In still further embodiments, the second loop antenna 32 may include a plurality of antenna elements, whereby the plurality of antenna elements circumscribe an outer perimeter of the first loop antenna 31. It is noted here that the shape and arrangement of the first loop antenna 31 and the second loop antenna 32 illustrated in FIG. 1 is a non-limiting example provided for illustration purposes. Additional non-limiting examples of loop antenna structural arrangements will be discussed in greater detail at least with respect to FIGS. 10A-10E.

Referring still to FIG. 1, as discussed previously for the first antenna 31, the second loop antenna 32 may include one or more loops formed by wiring on the printed circuit board 30. In certain embodiments, an inductance L2 of the second loop antenna 32 is smaller than an inductance L1 of the first loop antenna 31. This relationship of inductances between the first loop antenna 31 and the second loop antenna 32 provides for ease of driving the second loop antenna 32 with the first loop antenna 31. However, it should be appreciated that this relationship is not limiting, and in certain embodiments the inductance L2 of the second loop antenna may be greater than the inductance L1 of the first loop antenna. Additionally, a capacitor 36 may be connected at respective ends of the second loop antenna 32, as needed.

In certain embodiments, an NFC antenna device may include a high permeability magnetic sheet in addition to the loop antenna circuitry such as the antenna circuitry illustrated in FIG. 1. For example, a magnetic sheet (e.g., magnetic sheet 20 illustrated in FIG. 3) of substantially the same shape and plane size of the printed circuit board 30 may be included in an NFC antenna device in accordance with aspects of the present disclosure. The magnetic sheet may be formed of materials, such as ferrite materials, having high magnetic permeability with respect to the target frequency of the NFC antenna device. By the presence of a magnetic sheet with an NFC antenna device, losses between a system implementing NFC techniques may be mitigated, thereby improving communication performance. It is noted here that while an NFC antenna device may include a combination of Loop antenna and related circuitry in addition to magnetic sheet material as discussed above, this combination is not limiting and loop antenna circuitry alone may be independently recognized an NFC antenna device.

Figures 2A, 2B, 2C:
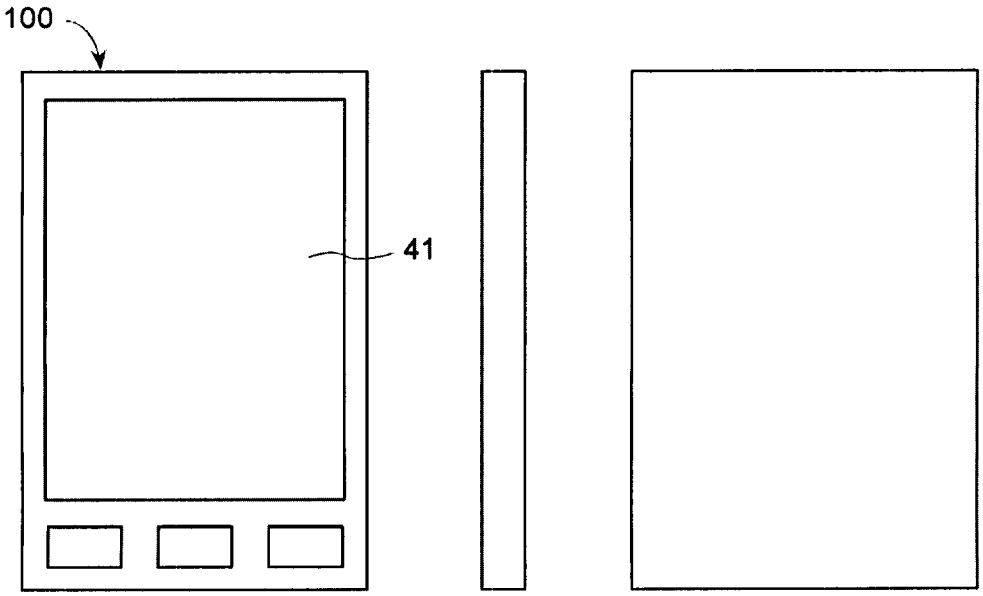
FIGS. 2A-2C respectively illustrate a front, side, and rear view of an exemplary terminal device that includes an NFC antenna device, according to certain embodiments.

Next, FIGS. 2A through 2C respectively illustrate a front view, a side view, and a rear view of a terminal device including an NFC antenna device, according to certain aspects of the present disclosure. In certain embodiments, an NFC antenna device such as the antenna device illustrated in FIG. 1 may be installed in a terminal device such as terminal device 100, which is represented structurally as a mobile device such as a smartphone or tablet device. The terminal device 100 includes a display screen 41 for outputting a graphical user interface, whereby touch screen sensors may be included with the display screen 41 such that input operations may be detected on an operation surface of the display screen 41. While the non-limiting example of FIGS. 2A through 2C illustrates a structural embodiment typical of a smartphone or tablet, it should be appreciated that the present disclosure is not limited to such a structure and other implementations of an NFC antenna device and related circuitry may be included in terminal devices of a folding type or a sliding type having separate housings.

Figure 3:
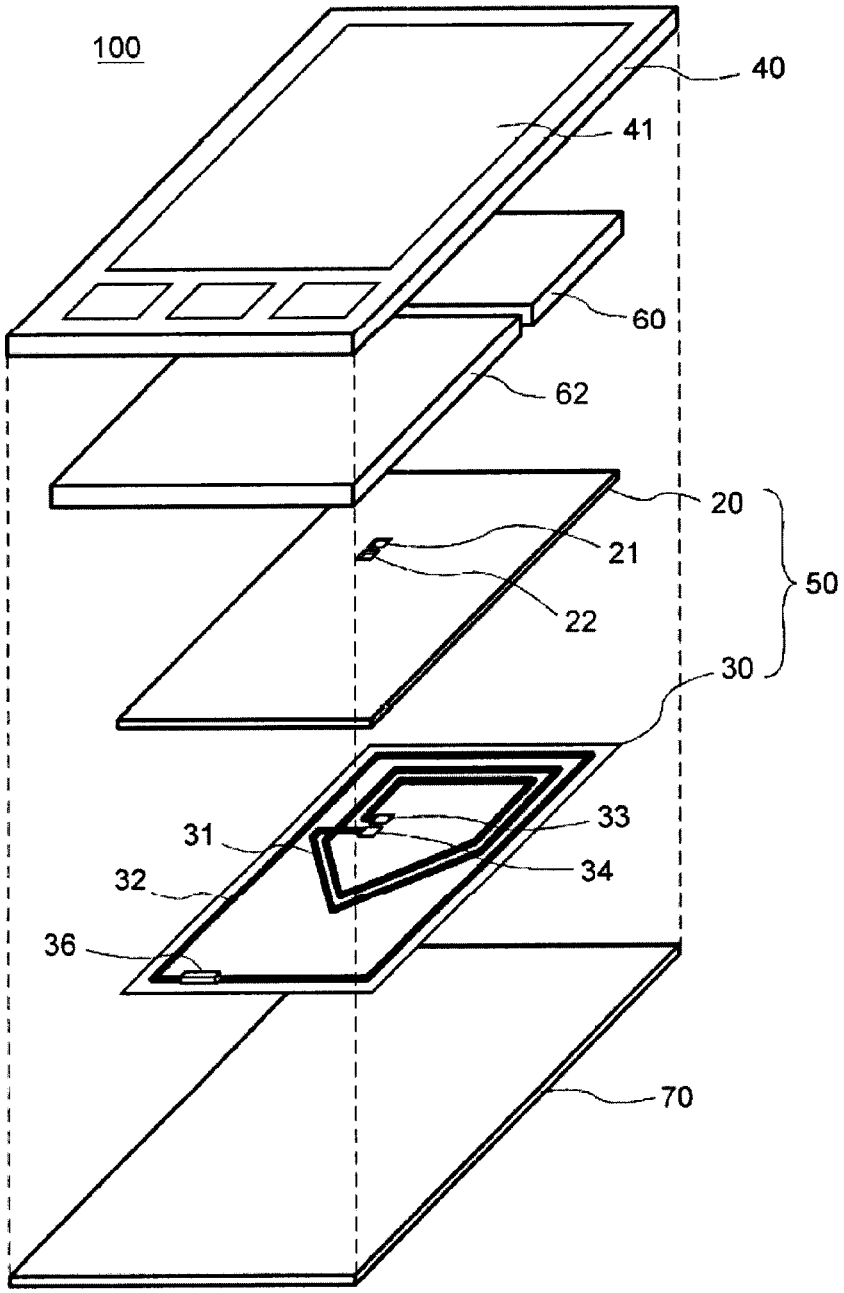
FIG. 3 illustrates a disassembled exemplary terminal device including an NFC antenna device from a top perspective, according to certain embodiments.

Next, FIG. 3 is a dissembled perspective view of the terminal device 100 illustrated in FIGS. 2A through 2C. The non-limiting example of FIG. 3 illustrates various elements that may be included in the terminal device 100. In this example, elements for performing NFC communications are housed within a casing formed by a display unit 40 and a rear cover 70. That is, the display unit 40, which includes the display screen 41, makes up a substantially front surface of the terminal device 100 and the rear cover 70 makes up a back surface of the terminal device 100. Accordingly, circuit elements for performing NFC communications may be housed internal to the display unit 40 and the rear cover 70. The printed circuit board 30 and a magnetic sheet 20 make up an NFC antenna device 50 in this example. Properties of the magnetic sheet 20 are discussed above and will not be repeated here. However, it should be appreciated that as discussed previously, the NFC antenna device 50 does not necessarily need to include a magnetic sheet such as the magnetic sheet 20. A battery 62 is provided within the terminal device 100 to power internal circuitry of the terminal device, including the printed circuit board 30. In addition, the battery 62 provides power for other processing circuitry, which may be included on a circuit board 60. In the example of FIG. 3, the battery 62 and the circuit board 60 are disposed on a common plane opposing a rear surface of the display unit 40. The magnetic sheet material 20 is sandwiched between the combination of the circuit board 60 and battery 62 and the printed circuit board 30. The magnetic sheet 20 may include holes 21 and 22, which are arranged at corresponding locations on the magnetic sheet 20 to the locations of the terminals 33 and 34 shown on the printed circuit 30. Accordingly, power may be delivered from the battery 62 to the first loop antenna 31 via, for example, pins included on the circuit board 60 that pass through the holes 21 and 22 and connect at the terminals 33 and 34. In certain embodiments, the NFC antenna device 50 may be disposed on an inside surface of the rear cover 70 and secured with an adhesive material such as double-sided tape.

Figure 4:
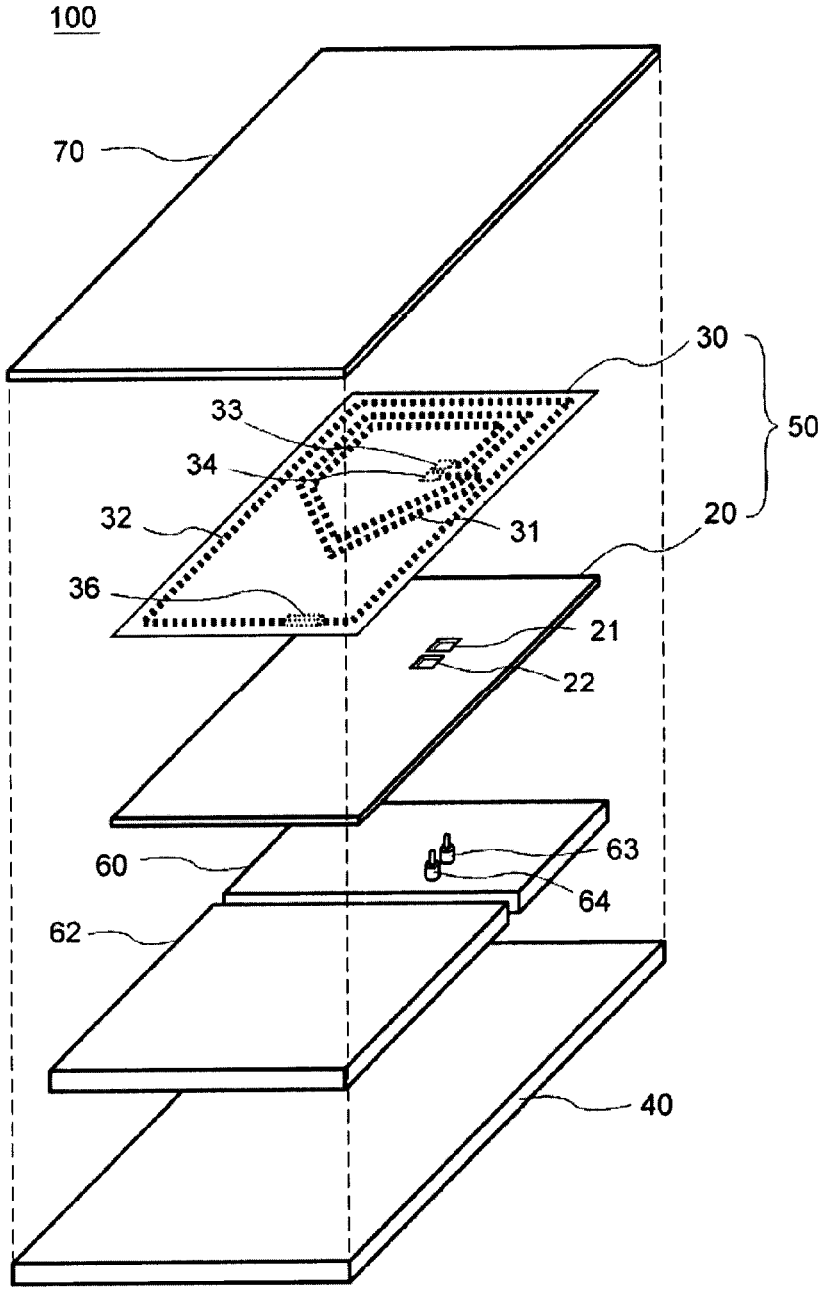
FIG. 4 illustrates a disassembled exemplary terminal device including an NFC antenna device from a bottom perspective, according to certain embodiments.

Next, FIG. 4 illustrates another disassembled view of the terminal device 100 from an opposite perspective relative to the illustration in FIG. 3. As shown in FIG. 4, the circuit board 60 may include contact pins 63 and 64. The contact pins 63 and 64 may be arranged at corresponding locations to the holes 21 and 22 on the magnetic sheet 20. As discussed previously, the battery 62 may provide power for control circuitry and other circuitry for performing NFC communications provided on the circuit board 60. Accordingly, the electrical current delivered from the battery 62 to the circuit board 60 may be transferred to the printed circuit board 30 via the contact pins 63 and 64. That is, the contact pins 63 and 64 in certain embodiments pass through the holes 21 and 22 such that connections to the terminals 33 and 34 may be established. Therefore, in this example, the first loop antenna 31 is electrically connected with respect to the circuit board 60 and battery 62. However, the second loop antenna 32 does not have a physical electrical connection to the circuit board 60 or the printed circuit board 30. The skilled artisan will appreciate that other methods of establishing an electrical power connection for the first loop antenna 31 may be implemented outside of the structural example provided in this figure.

Figure 5:
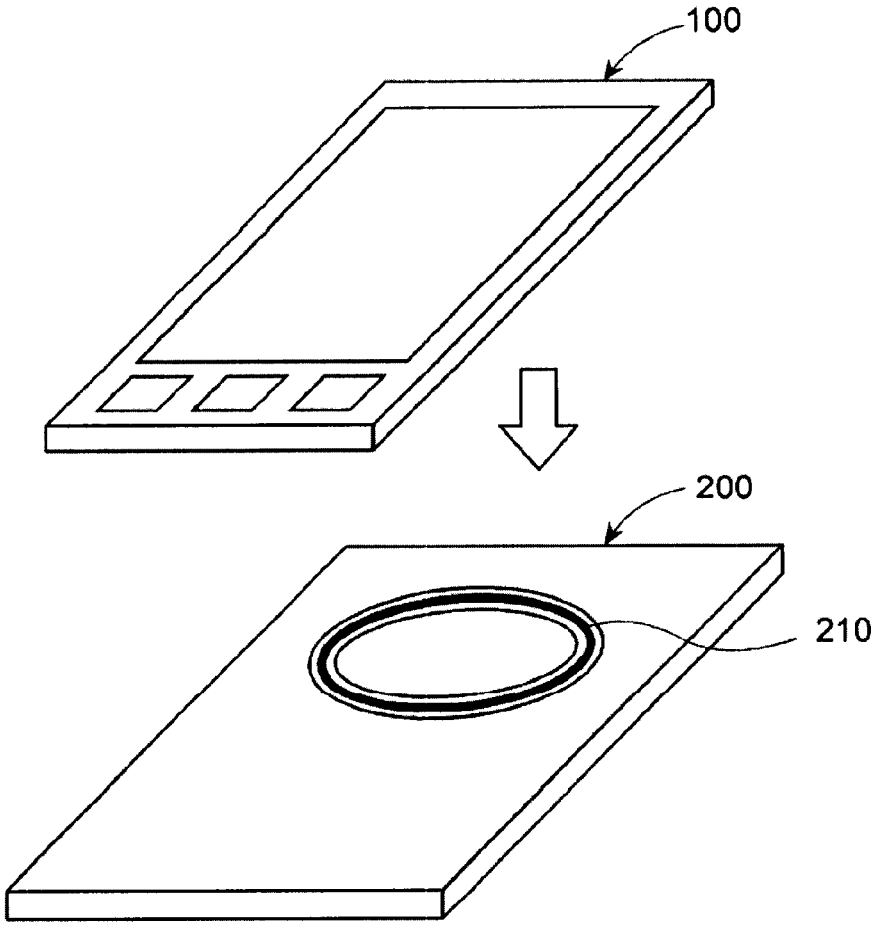
FIG. 5 illustrates relative positional relationships between an exemplary terminal device that includes an NFC antenna device and a tag device, according to certain embodiments.

Next, FIG. 5 illustrates relative positional relationships between an exemplary terminal device that includes an NFC antenna device and a tag device, according to certain embodiments. Referring to FIG. 5, FIG. 5 includes the terminal device 100 and an NFC tag device 200. As discussed previously, the terminal device 100 includes the NFC antenna device 50, which may function in this example as an NFC reader device or a reader/writer device. In this example, the NFC tag 200 is functioning as the communication target device. Communication with the NFC tag 200 is achieved by holding the terminal device 100 within a maximum communication range relative to the NFC tag 200. For example, NFC communications may be established between the terminal device 100 and the NFC tag device 200 by holding a back surface of the terminal device 100 in close proximity or in direct contract with the NFC tag device 200. Accordingly, an electromagnetic field generated by the first loop antenna of the terminal device 100 may induce a current flow in a loop antenna 210 in the NFC tag device 200. As a result of inductive coupling between the electromagnetic fields of the terminal device 100 and the NFC tag device 200, data exchanged between the terminal device 100 and the NFC tag device 200 may be executed.

Figure 6:
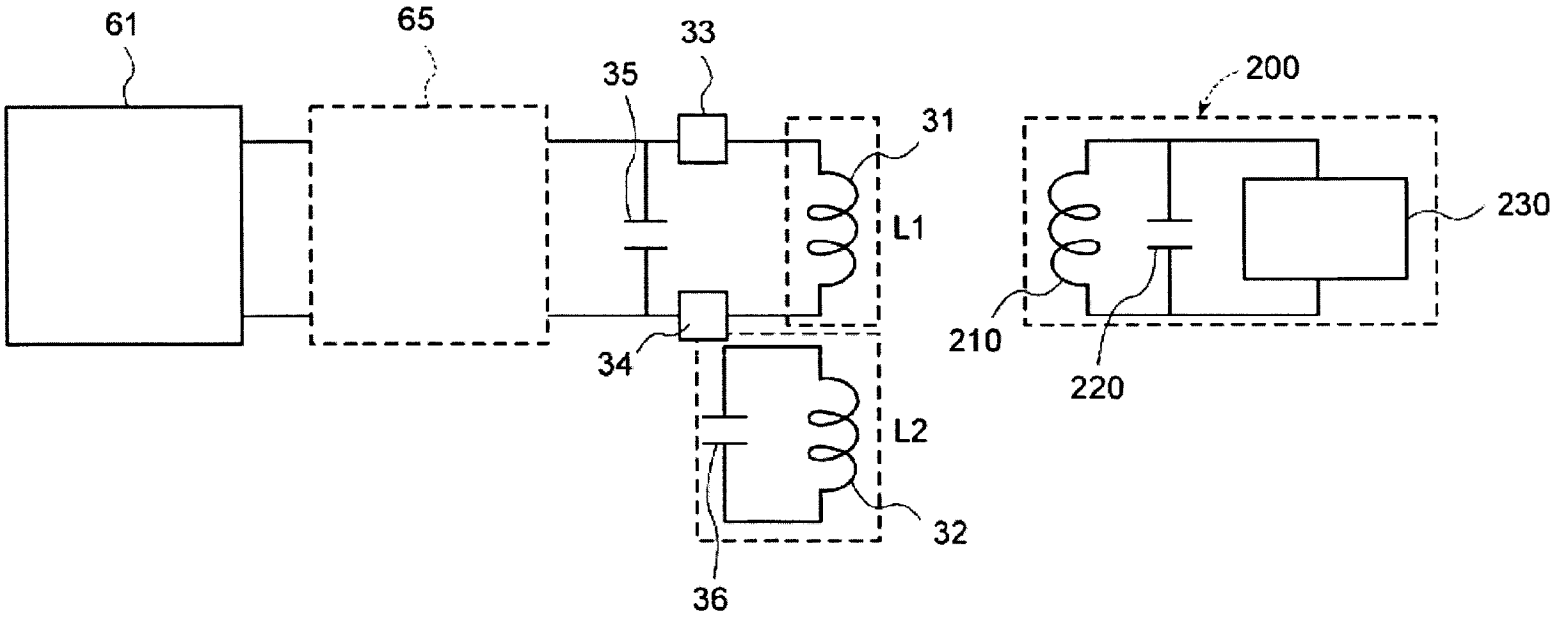
FIG. 6 illustrates an exemplary equivalent circuit diagram of the terminal device and tag device shown in FIG. 5.

Next, FIG. 6 illustrates a non-limiting exemplary equivalent circuit diagram of the terminal device and tag device shown in FIG. 5. As discussed previously, respective ends of the first loop antenna 31 of the terminal device 100 are connected to the terminals 33 and 34. The terminals 33 and 34 are connected to IC chip 61 through a matching circuit 65 mounted on the circuit board 60. IC chip 61 may include components which perform radio frequency (RF) signal processing corresponding to near field communications. The capacitor 35 is connected between the terminals 33 and 34 in FIG. 6. The capacitor 35 may include one or more capacitive elements, and the total capacitance of the capacitive elements included in the capacitor 35 may be selected as appropriate. Moreover, in certain embodiments, the capacitor 35 may be excluded from mounting between the terminals 33 and 34. In select embodiments, a parasitic capacitance of the circuit board 60 may be utilized for the capacitance between the terminals 33 and 34, or for capacitance provided for other elements. A capacitor 36 is shown connected between ends of the second loop antenna 32 such that a predetermined resonant frequency may be exhibited by the second loop antenna 32. In certain embodiments, the resonant frequency of the second loop antenna 32 may be shifted and adjusted with respect to the 13.56 MHz carrier frequency corresponding to near field communications standards. For example, the resonant frequency of the second loop antenna 32 may be adjusted above or below the 13.56 MHz NFC carrier frequency. The method of adjusting the resonant frequency of the second loop antenna 32 may be selected as appropriate.

Referring still to the exemplary equivalent circuit diagram of FIG. 6, a capacitor 220 is connected between ends of the loop antenna 210 of the NFC tag device 200. The NFC tag device 200 includes a resonance circuit such that a predetermined resonant frequency may be exhibited by the tag device 200. This resonant circuit is connected to an internal circuit 230 of the tag 200.

Figure 7A:
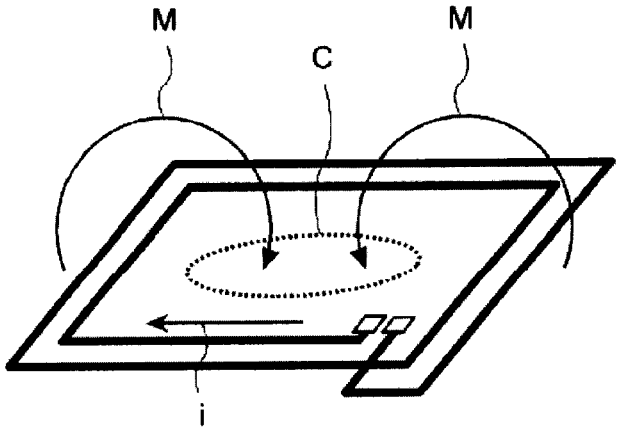
FIGS. 7A and 7B illustrate a problem with loop antennas having certain structural features.
Figure 7B:
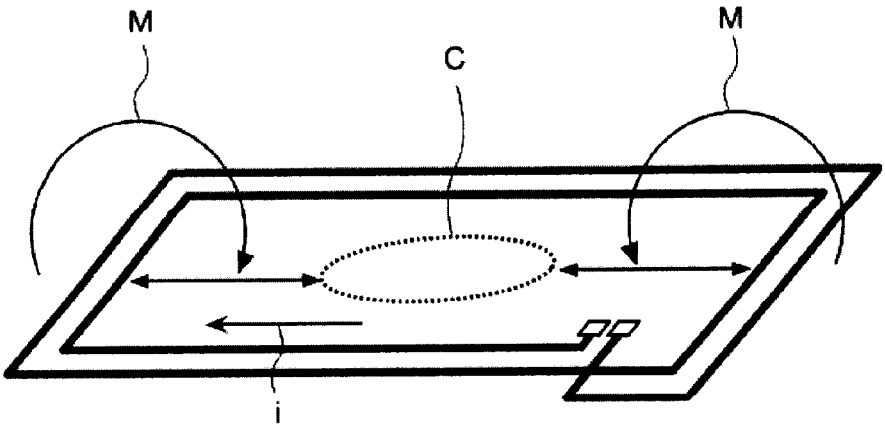

Next, FIGS. 7A and 7B illustrate a problem associated with loop antennas having certain structural characteristics. The direction of a current flow in the wiring of the loop antenna shown in FIGS. 7A and 7B is illustrated by the arrow i. A circular arc-shaped arrow M illustrates a direction of the magnetic field generated by the loop antennas as a result of the current flow. In a common square-shaped loop antenna, it is expected that by limiting the size of the loop to some extent that the magnetic field M of the loop antenna periphery concentrates on a center point C of the loop, as illustrated in FIG. 7A. However, as a loop antenna is expanded in size in order to extend the communication range for near field communications between devices, such as in the example of FIG. 7B, the strength of the magnetic field M of the loop antenna in the center part C decreases, thereby increasing the possibility that a communication failure will result due to positional displacement between devices.

Figure 8:
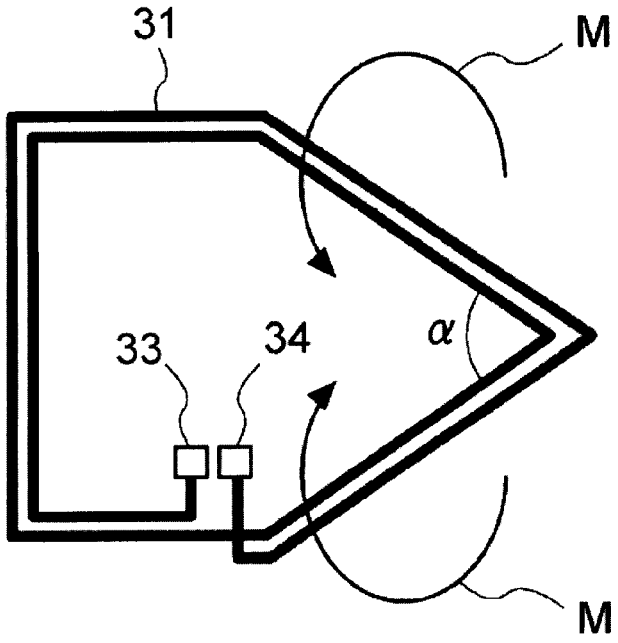
FIG. 8 illustrates an exemplary loop antenna, according to certain embodiments.

FIG. 8 illustrates a non-limiting example of a shape of the first loop antenna 31, according to certain embodiments. The exemplary shape of the first loop antenna 31 in the example of FIG. 8 is the shape of a pentagon similar to a home plate in baseball. An interior angle $\alpha$ formed by two sides of the first loop antenna 31 has a value of less than 90°. By providing such an acute-angled part of the loop shape of the loop antenna 31, even when extending an opening area of the loop antenna (i.e., the area within the inner periphery formed by the loop), it becomes easy to concentrate the magnetic field M on an inner peripheral area of the first loop antenna 31. That is, it becomes easy to keep the magnetic field intensity resultant from current flow in the first loop antenna concentrated in a center part of the loop, such as in the example of FIG. 7A.

Figure 9B:
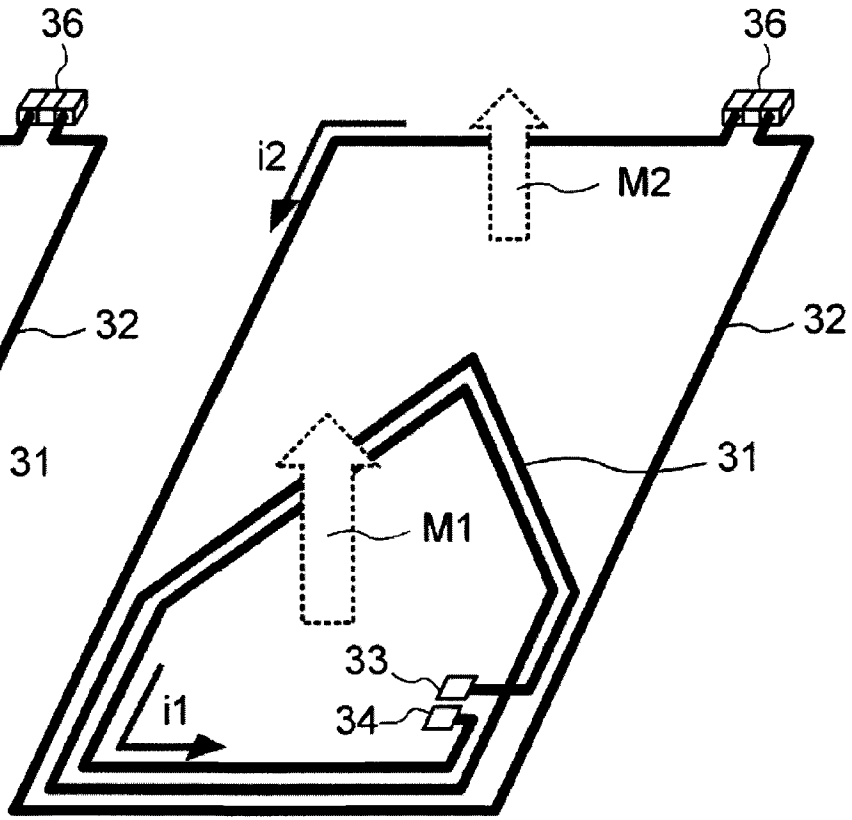
FIGS. 9A and 9B illustrate an effect of an exemplary structural arrangement that includes a first loop antenna and a second loop antenna, according to certain embodiments.
Figure 9A:
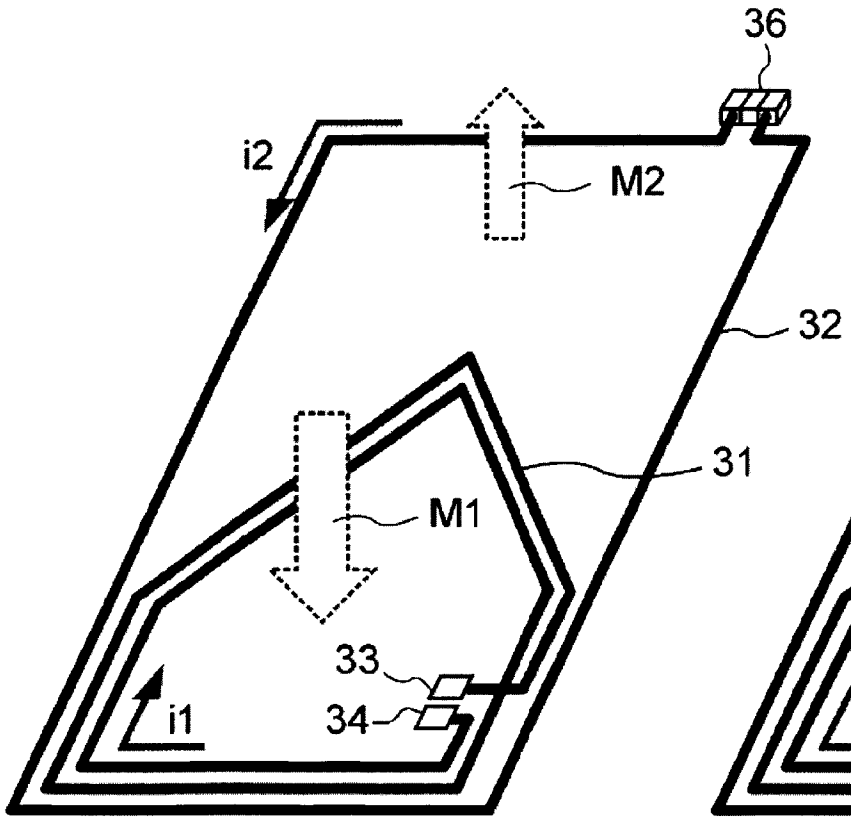

Next, FIGS. 9A and 9B illustrate the effect of an exemplary structural arrangement including a first loop antenna and a second loop antenna, according to certain embodiments. Specifically, the examples in FIGS. 9A and 9B illustrate the effect of combining the second loop antenna 32 on substantially the same plane as the first loop antenna 31 of FIG. 8. In this example, the first loop antenna 31 is disposed within an inner periphery of the second loop antenna 32, and three of the five sides of the first loop antenna 31 are running in a substantially parallel direction with respect to sides of the second loop antenna 32. As discussed above, the second loop antenna 32 may be tuned such that it may resonate on a frequency shifted from the resonant frequency of 13.56 MHz of the first loop antenna 31. By such a structure, the second loop antenna 32 receives a magnetic field which is radiated by an opposing device (e.g., the tag 200) while playing the role of extending the range of the magnetic field emitted by the first loop antenna 31. Specifically, the communication range in a direction parallel to the planar surface formed by the combination of loop antennas in FIGS. 9A and 9B is extended relative to the communication range in this direction provided by the first loop antenna 31 alone.

Referring still to the example of FIGS. 9A and 9B, when the second loop antenna 32 has a resonant frequency below 13.56 MHz, as shown in FIG. 9A, the current i2 flowing in the second loop antenna 32 flows in an opposite direction to the current i1 flowing in the first loop antenna 31. This produces mutually opposing and vertical magnetic fields M1 and M2 with respect to the opening surface (loop surface) of the first loop antenna 31 and the second loop antenna 32.

On the other hand, when the second loop antenna 32 has a resonant frequency in excess of 13.56 MHz, as shown in FIG. 9B, electric currents i1 and i2 flow in substantially the same direction within the first loop antenna 31 and the second loop antenna 32, respectively. This produces vertical magnetic fields M1 and M2 directed in substantially the same direction with respect to the opening surface of the first loop antenna 31 and the second loop antenna 32. Thus, it becomes possible to extend the communication range of the effective magnetic field in a direction parallel to a loop surface of the combination of loop antennas by adding the second loop antenna 32, which has a predetermined relationship with respect to the first loop antenna 31.

Next, FIGS. 10A through 10E illustrate non-limiting exemplary structural arrangements of loop antennas, according to certain embodiments. In particular, FIGS. 10A through 10E illustrate exemplary shapes of the first loop antenna 31 and the second loop antenna 32, relative positional relationships between loop antennas, the number of antenna elements included in the second loop antenna 32, and printed circuit boards 30*a* through 30*e* corresponding to these different combinations. It should be appreciated that the structural arrangements illustrated in FIGS. 10A through 10E should not be construed as limiting, and the teachings of the present disclosure may be adapted such that other shapes, sizes, positional relationships, etc., may be considered.

Figure 10A:
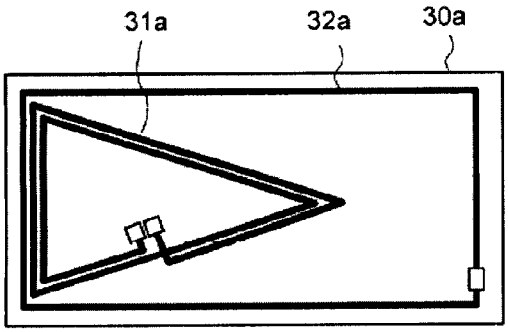
FIGS. 10A-10E illustrate non-limiting exemplary structural arrangements of loop antennas, according to certain embodiments.
Figure 10B:
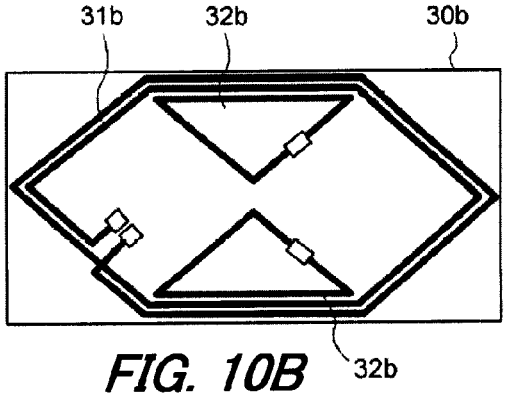
Figure 10C:
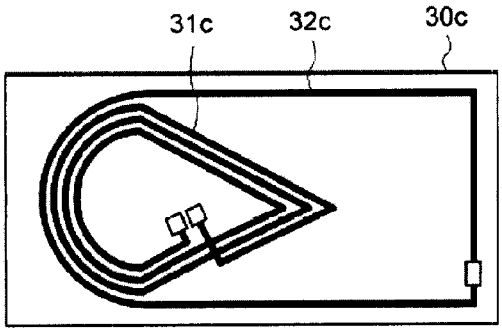

FIGS. 10A, 10B, and 10C respectively illustrate printed circuit boards 30*a*, 30*b*, and 30*c*, which include an interior contact type NFC antenna device. That is, one loop antenna is disposed within an interior perimeter of another loop antenna such that one or more sides of the inner loop antenna run in a substantially parallel direction to one or more sides of the outer loop antenna. As shown in FIG. 10C, one or more of the sides of the polygonal loop antenna shapes may be curved.

Figure 10D:
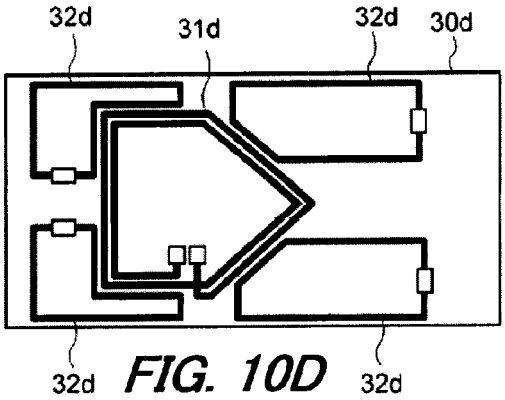
Figure 10E:
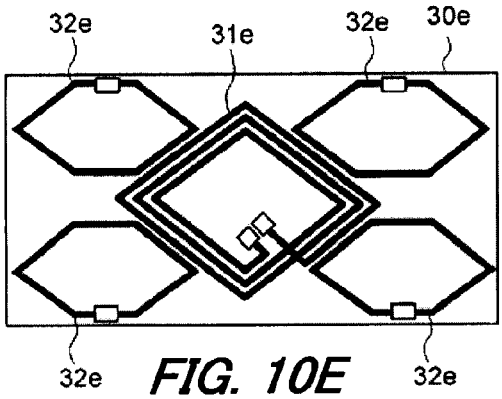

FIGS. 10D and 10E illustrate examples of printed circuit boards 30*d* and 30*e*, which each include loop antenna arrangements of a circumscription type. That is, the first and second loop antennas are arranged on the printed circuit boards such that at least one side of each loop runs in a substantially parallel direction to at least one side of the opposing loop. As illustrated in FIGS. 10D and 10E, the second loop antenna 32 may include multiple antenna elements, such as antenna sub-elements 32*d* and 32*e* of FIG. 10D and FIG. 10E, respectively.

Obviously, numerous modifications and variations of the present disclosure are possible in light of the above teachings. It is therefore to be understood that within the scope of the appended claims, the invention may be practiced otherwise than as specifically described herein. For example, advantageous results may be achieved if the steps of the disclosed techniques were performed in a different sequence, if components in the disclosed systems were combined in a different manner, or if the components were replaced or supplemented by other components. The functions, processes and algorithms described herein may be performed in hardware or software executed by hardware, including computer processors and/or programmable processing circuits configured to execute program code and/or computer instructions to execute the functions, processes and algorithms described herein. A processing circuit includes a programmed processor, as a processor includes circuitry. A processing circuit also includes devices such as an application specific integrated circuit (ASIC) and conventional circuit components arranged to perform the recited functions.

The functions and features described herein may also be executed by various distributed components of a system. For example, one or more processors may execute these system functions, wherein the processors are distributed across multiple components communicating in a network. The distributed components may include one or more client and/or server machines, in addition to various human interface and/or communication devices (e.g., display monitors, smart phones, tablets, personal digital assistants (PDAs)). The network may be a private network, such as a LAN or WAN, or may be a public network, such as the Internet. Input to the system may be received via direct user input and/or received remotely either in real-time or as a batch process. Additionally, some implementations may be performed on modules or hardware not identical to those described. Accordingly, other implementations are within the scope that may be claimed.

It must be noted that, as used in the specification and the appended claims, the singular forms "a," "an," and "the" include plural referents unless the context clearly dictates otherwise.

The above disclosure also encompasses the embodiments noted below.

(1) A device comprising: a first loop antenna including at least three sides, wherein at least two of the sides form an acute interior angle; a second loop antenna that includes at least one side that runs in a substantially parallel direction to one of the at least three sides of the first loop antenna, wherein the first loop antenna and the second loop antenna are arranged substantially on the same plane.

(2) The device of (1), wherein the first loop antenna has a substantially polygonal shape.

(3) The device of (1) or (2), wherein at least one of the sides of the first loop antenna is curved.

(4) The device of any one of (1) to (3), wherein the first loop antenna is disposed within an interior of the second loop antenna.

(5) The device of any one of (1) to (4), wherein the first loop antenna and the second loop antenna are mounted on a circuit board.

(6) The device of any one of (1) to (5), wherein the first loop antenna and the second loop antenna are mounted on different surfaces of the circuit board.

(7) The device of any one of (1) to (6), wherein an outer perimeter of the first loop antenna is capable of being disposed, without overlap, within an inner perimeter of the second loop antenna.

(8) The device of any one of (1) to (7), wherein the first loop antenna and the second loop antenna are mounted on a common side of the circuit board.

(9) The device of any one of (1) to (8), wherein the first loop antenna is disposed within an interior of the second loop antenna.

(10) The device of any one of (1) to (9), wherein: the first loop antenna is electrically coupled to the circuit board such that the first loop antenna is capable of receiving power from a power source connected to the circuit board, and the second loop antenna is electrically disconnected from the power source.

(11) The device of any one of (1) to (10), wherein an inductance of the second loop antenna is smaller than an inductance of the first loop antenna.

(12) The device of any one of (1) to (11), wherein the first loop antenna and the second loop antenna operate using a near field communication (NFC) standard.

(13) The device of any one of (1) to (12), wherein the resonant frequency of the first loop antenna is 13.56 MHz.

(14) The device of any one of (1) to (13), further comprising circuitry configured to adjust a resonant frequency of the second loop antenna.

(15) The device of any one of (1) to (14), wherein when the resonant frequency of the second loop antenna is adjusted to be greater than the resonant frequency of the first loop antenna, current in the first loop antenna flows in a same direction as current in the second loop antenna.

(16) The device of any one of (1) to (15), wherein a magnetic field produced as a result of the current flow in the first loop antenna is in a same direction as a magnetic field produced as a result of the current flow in the second loop antenna.

(17) The device of any one of (1) to (16), wherein: when the resonant frequency of the second loop antenna is adjusted to be less than the resonant frequency of the first loop antenna, current in the first loop antenna flows in a different direction as current in the second loop antenna, and a magnetic field produced as a result of the current flow in the first loop antenna is in a different direction than a magnetic field produced as a result of the current flow in the second loop antenna.

(18) The device of any one of (1) to (17), wherein the second loop antenna includes a plurality of antenna sub-elements circumscribing an outer periphery of the first loop antenna.

(19) A mobile communication device comprising: near field communication circuitry including a first loop antenna including at least three sides, wherein at least two of the sides form an acute interior angle; a second loop antenna that includes at least one side that runs in a substantially parallel direction to one of the at least three sides of the first loop antenna, wherein the first loop antenna and the second loop antenna are arranged substantially on the same plane.

(20) A method comprising: arranging, on substantially the same plane, a first loop antenna and a second loop antenna, wherein the first loop antenna includes at least three sides, at least two of the sides of the first loop antenna form an acute interior angle, and the second loop antenna includes at least one side that runs in a substantially parallel direction to one of the at least three sides of the first loop antenna; receiving, in the first loop antenna, an electrical current from a power source; generating, by the first loop antenna, a magnetic field in response to receiving the electrical current; and adjusting, by tuning circuitry, the resonant frequency of the second loop antenna to be greater than the resonant frequency of the first loop antenna.

The invention claimed is:

1. A device comprising:

a first loop antenna including at least three sides, wherein at least two of the sides form an acute interior angle;

a second loop antenna that includes at least one side that runs in a substantially parallel direction to one of the at least three sides of the first loop antenna, wherein the first loop antenna and the second loop antenna are arranged substantially on the same plane, the first loop antenna is electrically coupled to a circuit board such that the first loop antenna is capable of receiving power from a power source connected to the circuit board, and the second loop antenna is electrically disconnected from the power source.

2. The device of claim 1, wherein the first loop antenna has a substantially polygonal shape.

3. The device of claim 1, wherein at least one of the sides of the first loop antenna is curved.

4. The device of claim 1, wherein the first loop antenna is disposed within an interior of the second loop antenna.

5. The device of claim 1, wherein the first loop antenna and the second loop antenna are mounted on a circuit board.

6. The device of claim 5, wherein the first loop antenna and the second loop antenna are mounted on different surfaces of the circuit board.

7. The device of claim 6, wherein an outer perimeter of the first loop antenna is capable of being disposed, without overlap, within an inner perimeter of the second loop antenna.

8. The device of claim 5, wherein the first loop antenna and the second loop antenna are mounted on a common side of the circuit board.

9. The device of claim 8, wherein the first loop antenna is disposed within an interior of the second loop antenna.

10. The device of claim 1, wherein the second loop antenna includes a plurality of antenna sub-elements circumscribing an outer periphery of the first loop antenna.

11. The device of claim 1, wherein an inductance of the second loop antenna is smaller than an inductance of the first loop antenna.

12. The device of claim 1, wherein the first loop antenna and the second loop antenna operate using a near field communication (NFC) standard.

13. The device of claim 12, wherein a resonant frequency of the first loop antenna is 13.56 MHz.

14. The device of claim 13, further comprising circuitry configured to adjust a resonant frequency of the second loop antenna.

15. The device of claim 14, wherein when the resonant frequency of the second loop antenna is adjusted to be greater than the resonant frequency of the first loop antenna, current in the first loop antenna flows in a same direction as current in the second loop antenna.

16. The device of claim 14, wherein a magnetic field produced as a result of the current flow in the first loop antenna is in a same direction as a magnetic field produced as a result of the current flow in the second loop antenna.

17. The device of claim 14, wherein:

when the resonant frequency of the second loop antenna is adjusted to be less than the resonant frequency of the first loop antenna, current in the first loop antenna flows in a different direction as current in the second loop antenna, and a magnetic field produced as a result of the current flow in the first loop antenna is in a different direction than a magnetic field produced as a result of the current flow in the second loop antenna.

18. A mobile communication device comprising:

near field communication circuitry including a first loop antenna including at least three sides, wherein at least two of the sides form an acute interior angle;

a second loop antenna that includes at least one side that runs in a substantially parallel direction to one of the at least three sides of the first loop antenna, wherein the first loop antenna and the second loop antenna are arranged substantially on the same plane, the first loop antenna is electrically coupled to a circuit board such that the first loop antenna is capable of receiving power from a power source connected to the circuit board, and the second loop antenna is electrically disconnected from the power source.

19. A method comprising:

arranging, on substantially the same plane, a first loop antenna and a second loop antenna, wherein the first loop antenna includes at least three sides, at least two of the sides of the first loop antenna form an acute interior angle, and the second loop antenna includes at least one side that runs in a substantially parallel direction to one of the at least three sides of the first loop antenna;

receiving, in the first loop antenna, an electrical current from a power source;

generating, by the first loop antenna, a magnetic field in response to receiving the electrical current; and adjusting, by tuning circuitry, the resonant frequency of the second loop antenna to be greater than the resonant frequency of the first loop antenna.

* * * * *